US010735886B2

(12) United States Patent
Ehara et al.

(10) Patent No.: US 10,735,886 B2
(45) **Date of Patent: *Aug. 4, 2020**

(54) BINAURAL RENDERING APPARATUS AND METHOD FOR PLAYING BACK OF MULTIPLE AUDIO SOURCES

(71) Applicant: PANASONIC INTELLECTUAL PROPERTY CORPORATION OF AMERICA, Torrance, CA (US)

(72) Inventors: Hiroyuki Ehara, Kanagawa (JP); Kai Wu, Singapore (SG); Sua Hong Neo, Singapore (SG)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/724,921

(22) Filed: Dec. 23, 2019

(65) Prior Publication Data

US 2020/0128351 A1 Apr. 23, 2020

Related U.S. Application Data

(63) Continuation of application No. 16/341,861, filed as application No. PCT/JP2017/036738 on Oct. 11, 2017, now Pat. No. 10,555,107.

(30) Foreign Application Priority Data

Oct. 28, 2016 (JP) ..... 2016-211803

(51) Int. Cl.

| | |
|---|---|
| ***G10L 19/008*** | (2013.01) |
| ***H04S 7/00*** | (2006.01) |
| ***H04S 1/00*** | (2006.01) |

(52) U.S. Cl.

CPC ..... *H04S 7/304* (2013.01); *G10L 19/008* (2013.01); *H04S 1/005* (2013.01); *H04S 7/305* (2013.01);

(Continued)

(58) Field of Classification Search

CPC ... G10L 19/008; H04S 1/005; H04S 2400/01; H04S 2420/01; H04S 7/304; H04S 7/305

(Continued)

(56) References Cited

U.S. PATENT DOCUMENTS

| | | |
|---|---|---|
| 2010/0191537 A1 | 7/2010 | Breebaart |
| 2011/0040397 A1 | 2/2011 | Kraemer et al. |

(Continued)

OTHER PUBLICATIONS

International Search Report, dated Jan. 9, 2018, for International Application No. PCT/JP2017/036738.

(Continued)

*Primary Examiner* — Vivian C Chin
*Assistant Examiner* — Friedrich Fahnert
(74) *Attorney, Agent, or Firm* — Greenblum & Bernstein, P.L.C.

(57) ABSTRACT

A method of generating binaural headphone playback signals given multiple audio source signals with an associated metadata and binaural room impulse response (BRIR) database, wherein the multiple audio source signals can be channel-based, object-based, or a mixture of both signals. The method includes grouping the multiple audio source signals according to positions of the audio sources in a hierarchical manner, and parameterizing BRIR to be used for rendering. The method also includes dividing each audio source signal to be rendered into a number of blocks and frames, averaging the parameterized BRIR sequences iden- (Continued)

tified with a hierarchically grouping result, and downmixing the divided audio source signals identified with the hierarchically grouping result.

16 Claims, 8 Drawing Sheets

(52) U.S. Cl.
CPC ..... *H04S 2400/01* (2013.01); *H04S 2420/01* (2013.01)

(58) Field of Classification Search
USPC ..... 381/1, 22, 23, 300, 303, 310, 321; 700/94
See application file for complete search history.

(56) References Cited

U.S. PATENT DOCUMENTS

| | | | |
|---|---|---|---|
| 2011/0264456 | A1 | 10/2011 | Koppens et al. |
| 2012/0039477 | A1 | 2/2012 | Schijers et al. |
| 2012/0243713 | A1 | 9/2012 | Hess |
| 2015/0289063 | A1 | 10/2015 | Ma |
| 2016/0255453 | A1 | 9/2016 | Fueg et al. |

OTHER PUBLICATIONS

ISO/IEC DIS 23008-3, "Information technology—High efficiency coding and media delivery in heterogeneous environments—Part 3: 3D audio", Jul. 25, 2014.
Taegyu Lee et al., "Scalable Multiband Binaural Renderer for MPEG-H 3D Audio", IEEE Journal of Selected Topics in Signal Processing, vol. 9, No. 5, Apr. 23, 2015, pp. 907-920.

[Fig. 1]
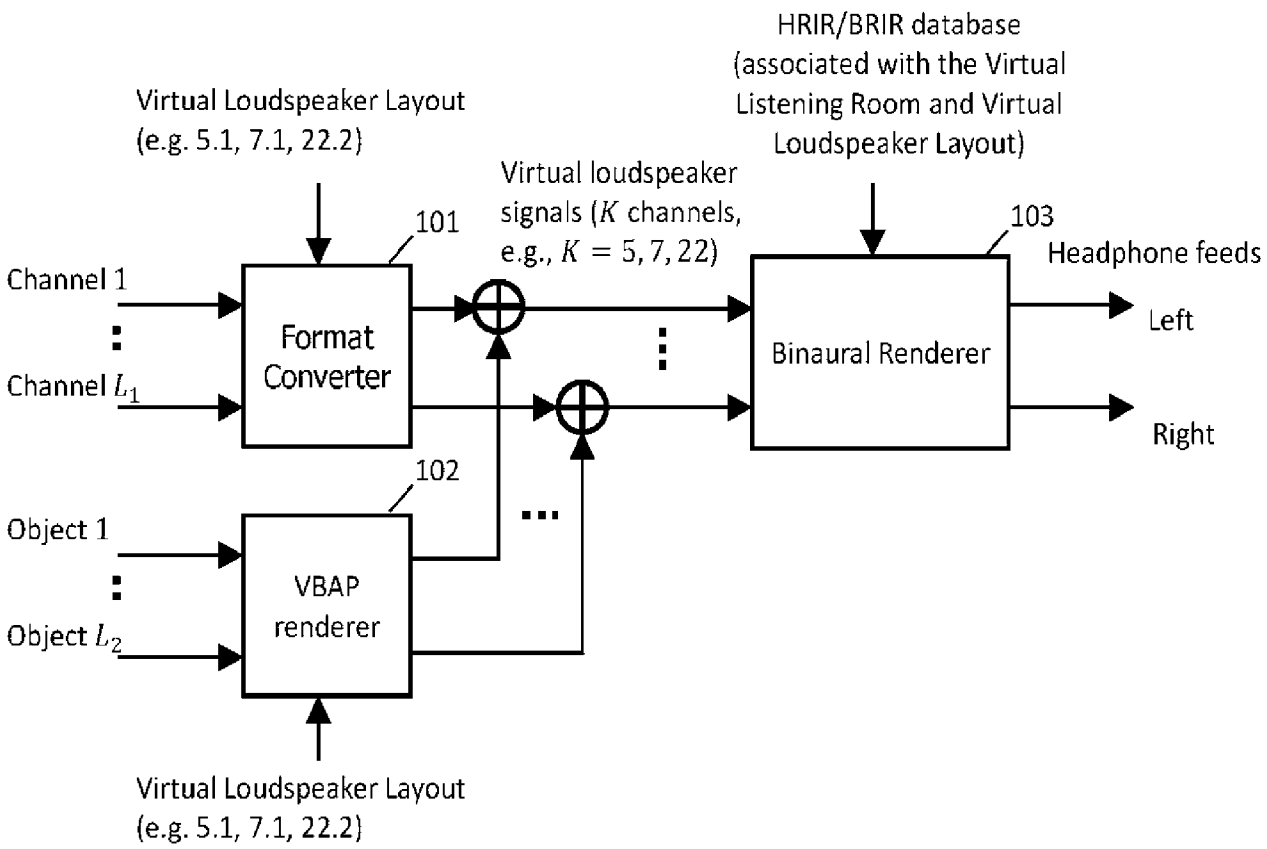

[Fig. 2]
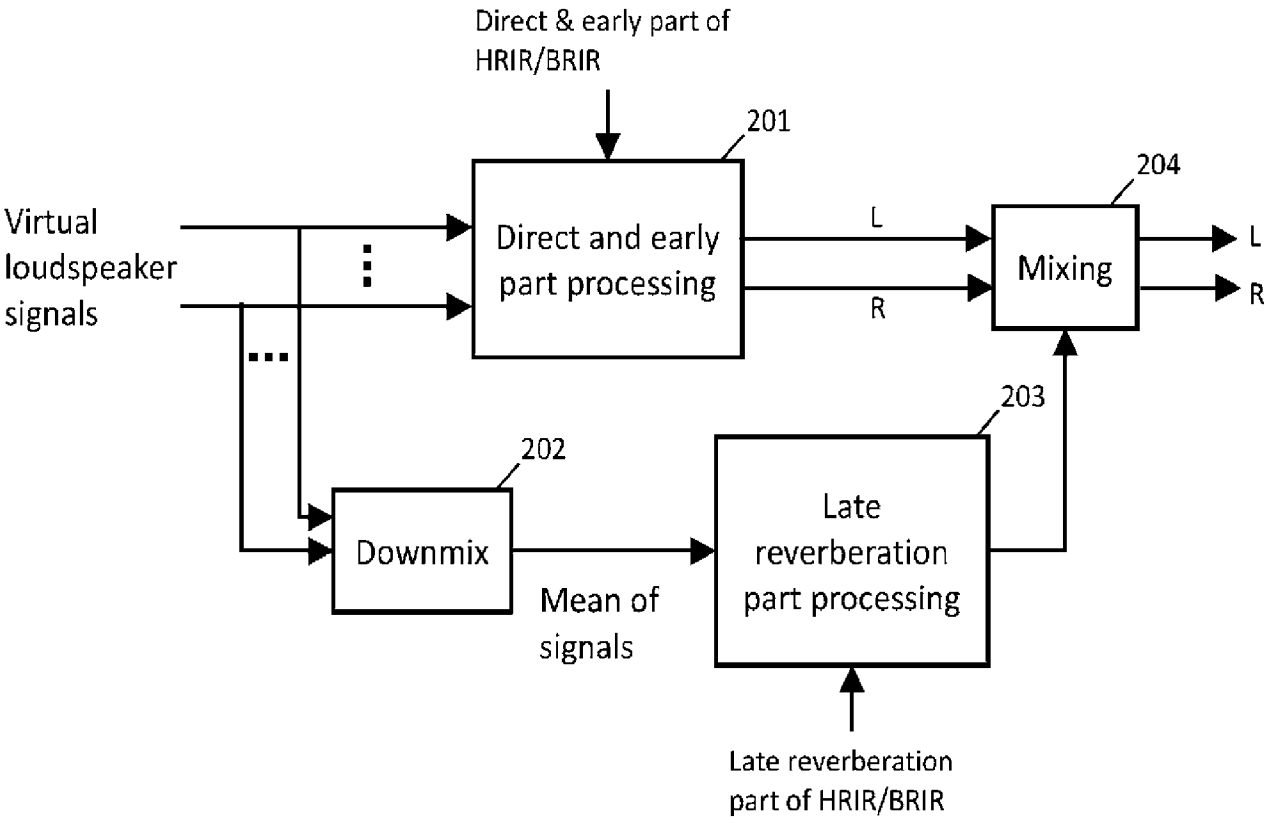

[Fig. 3]
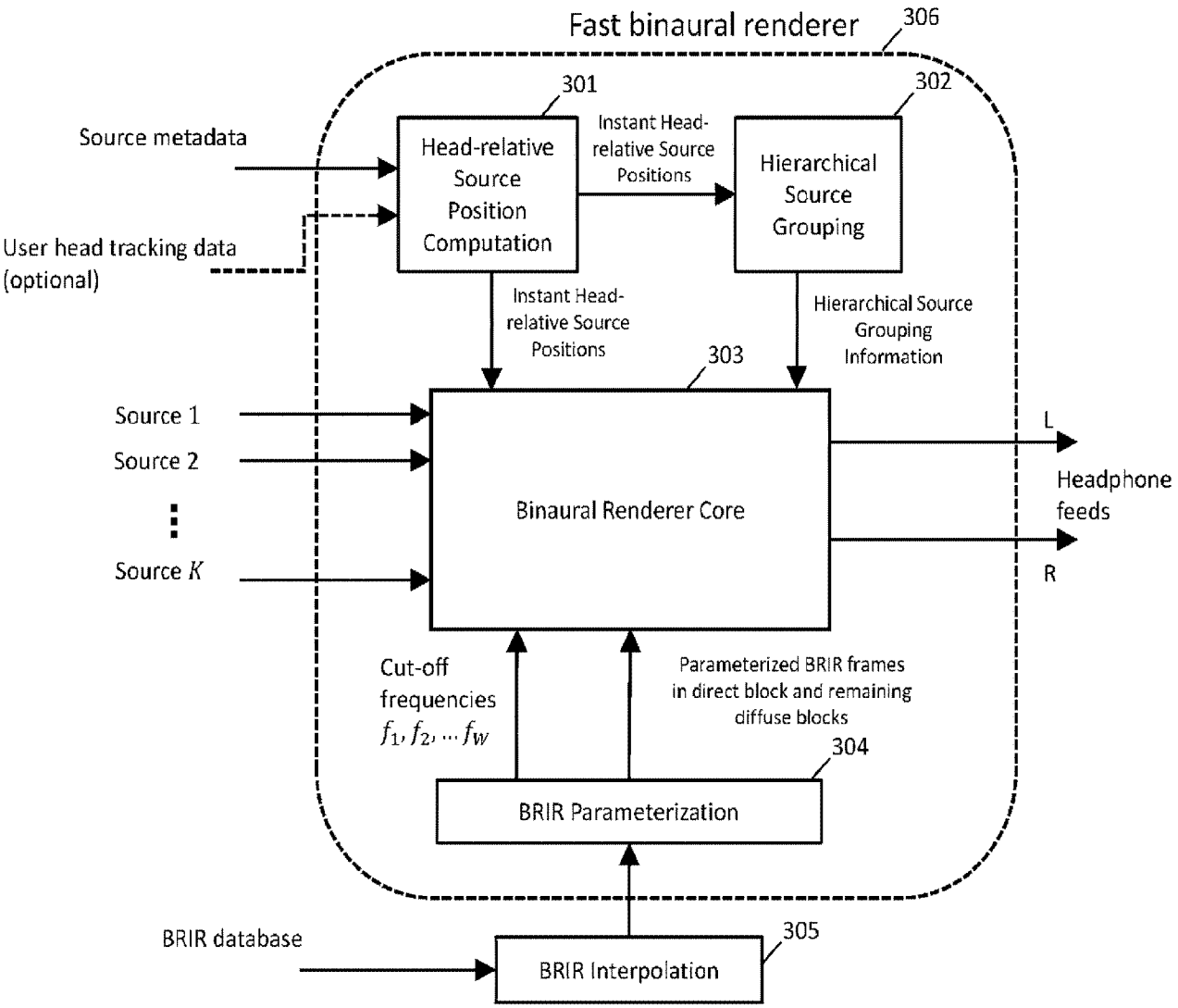

[Fig. 4]
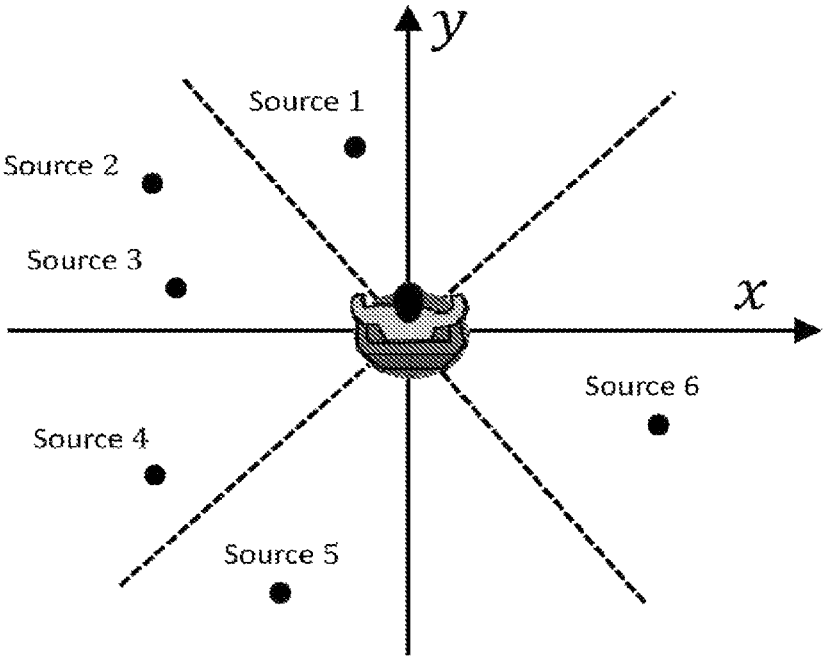

[Fig 5]
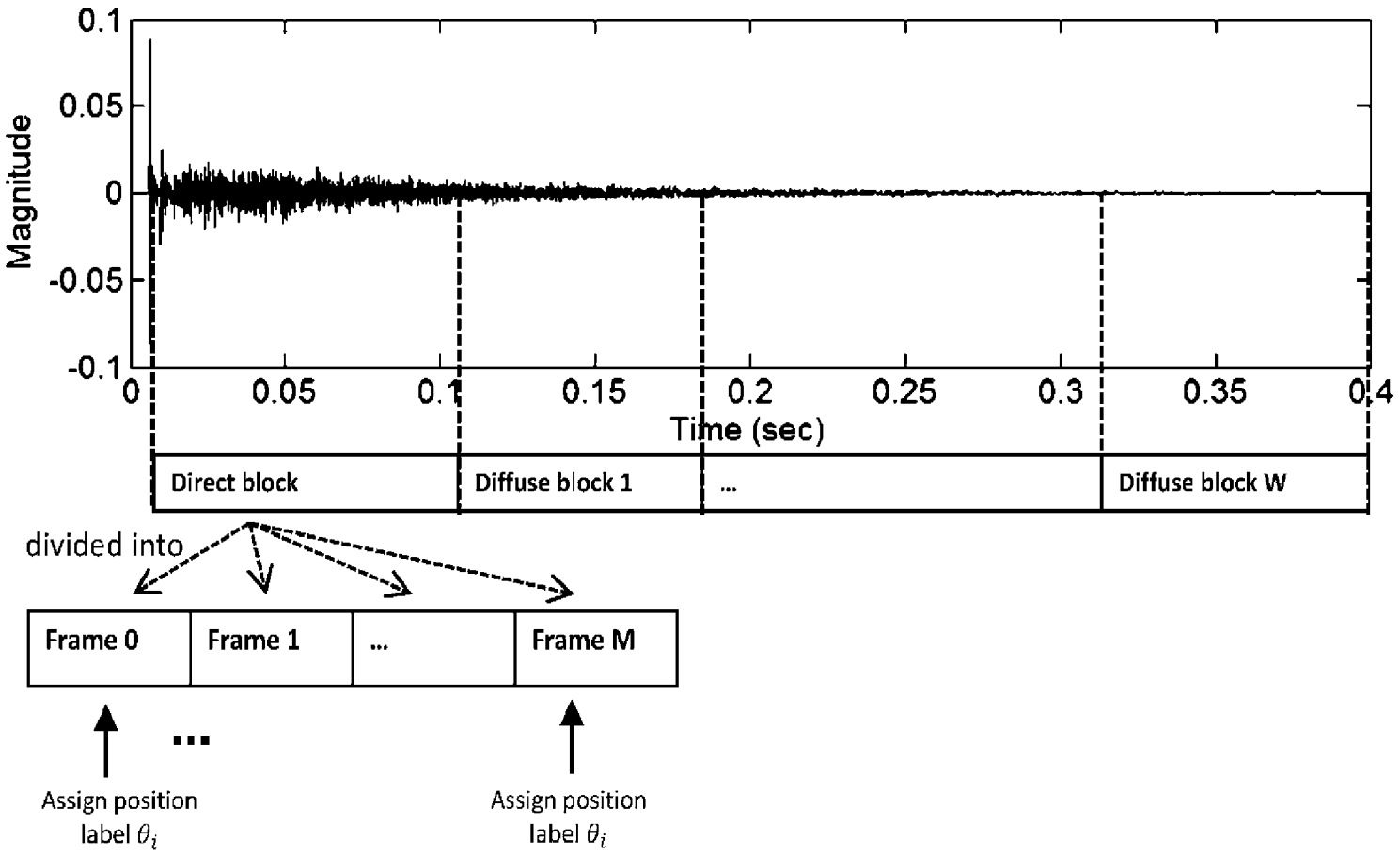

[Fig. 6]
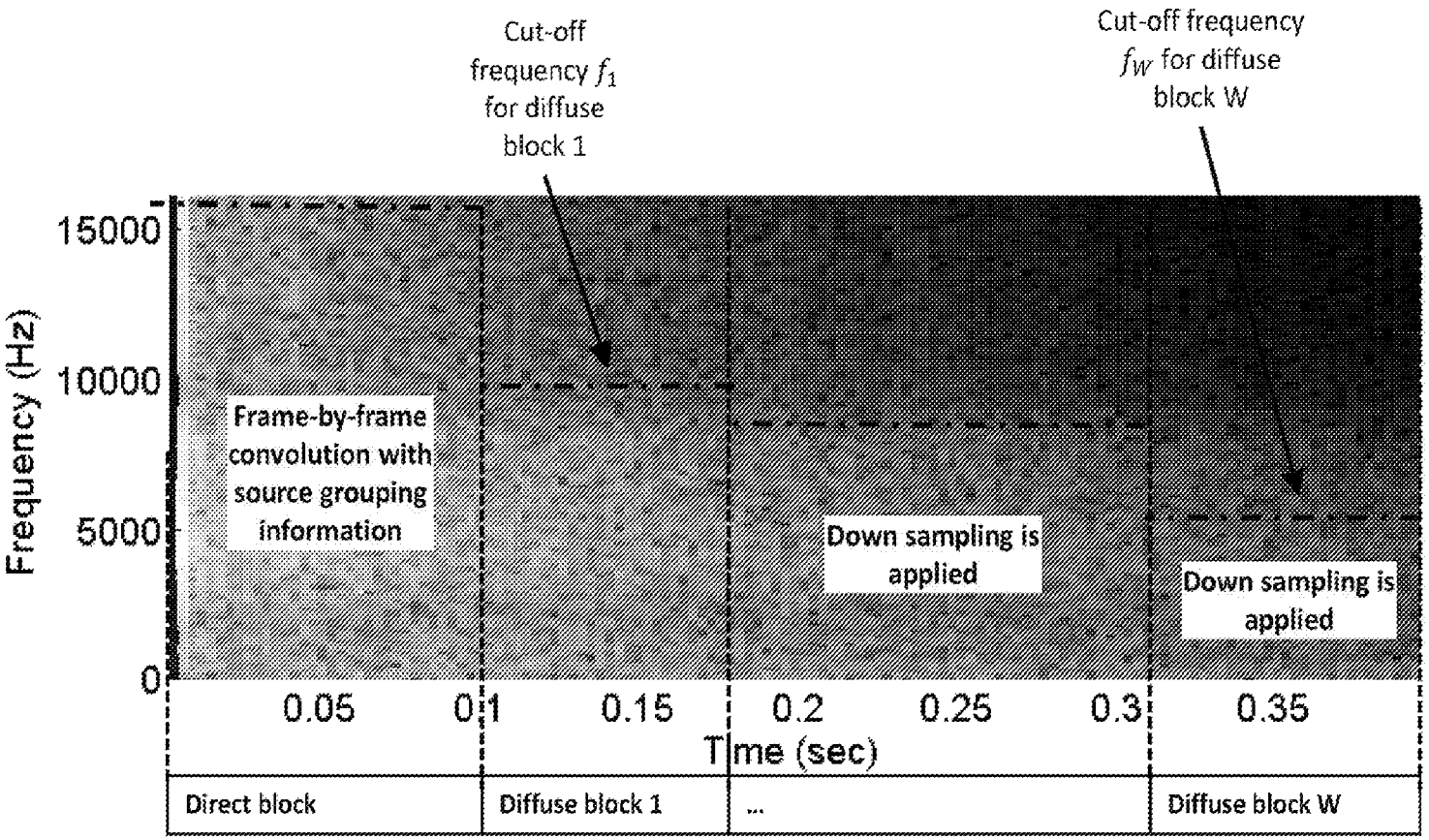

[Fig. 7]
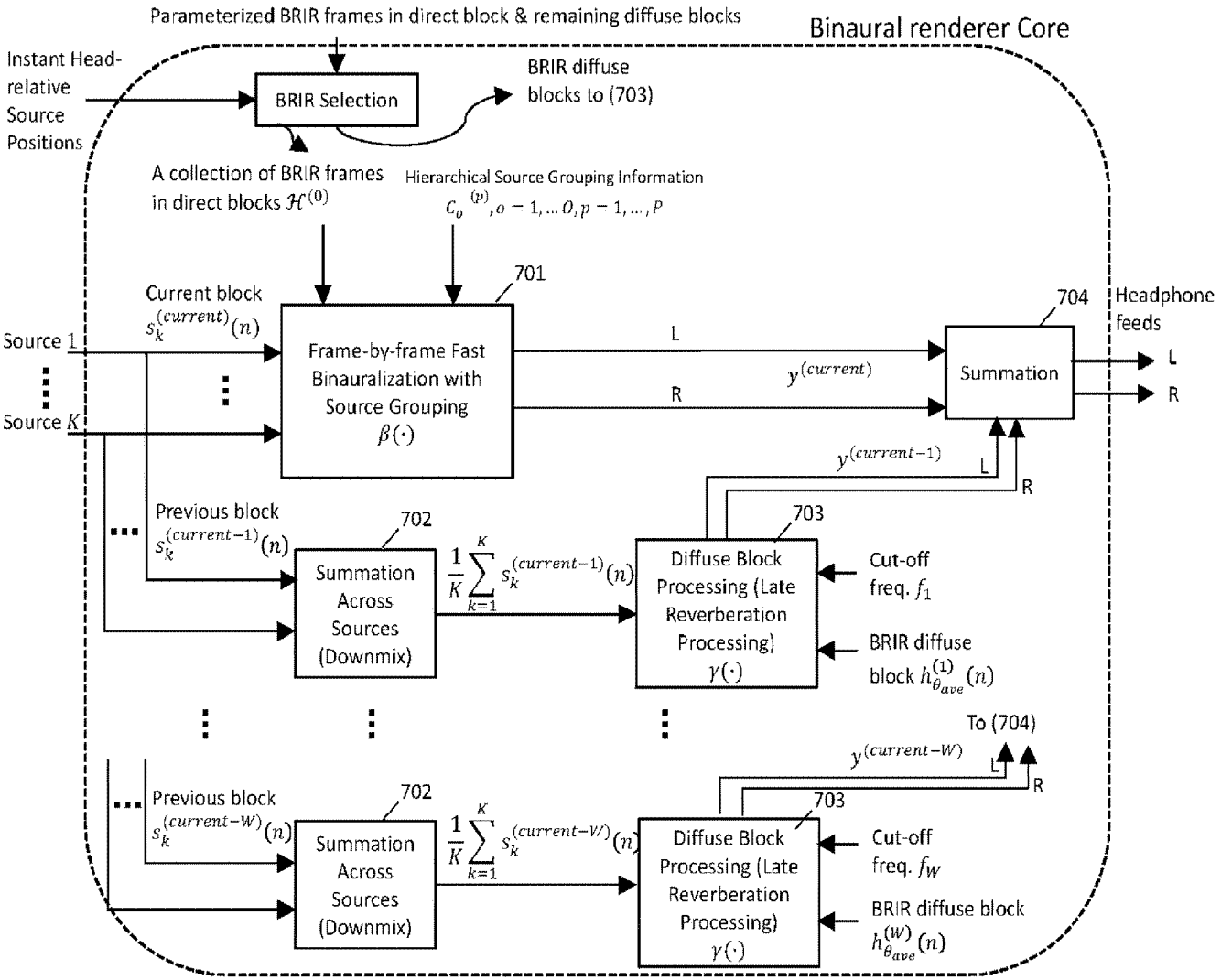

[Fig. 8]
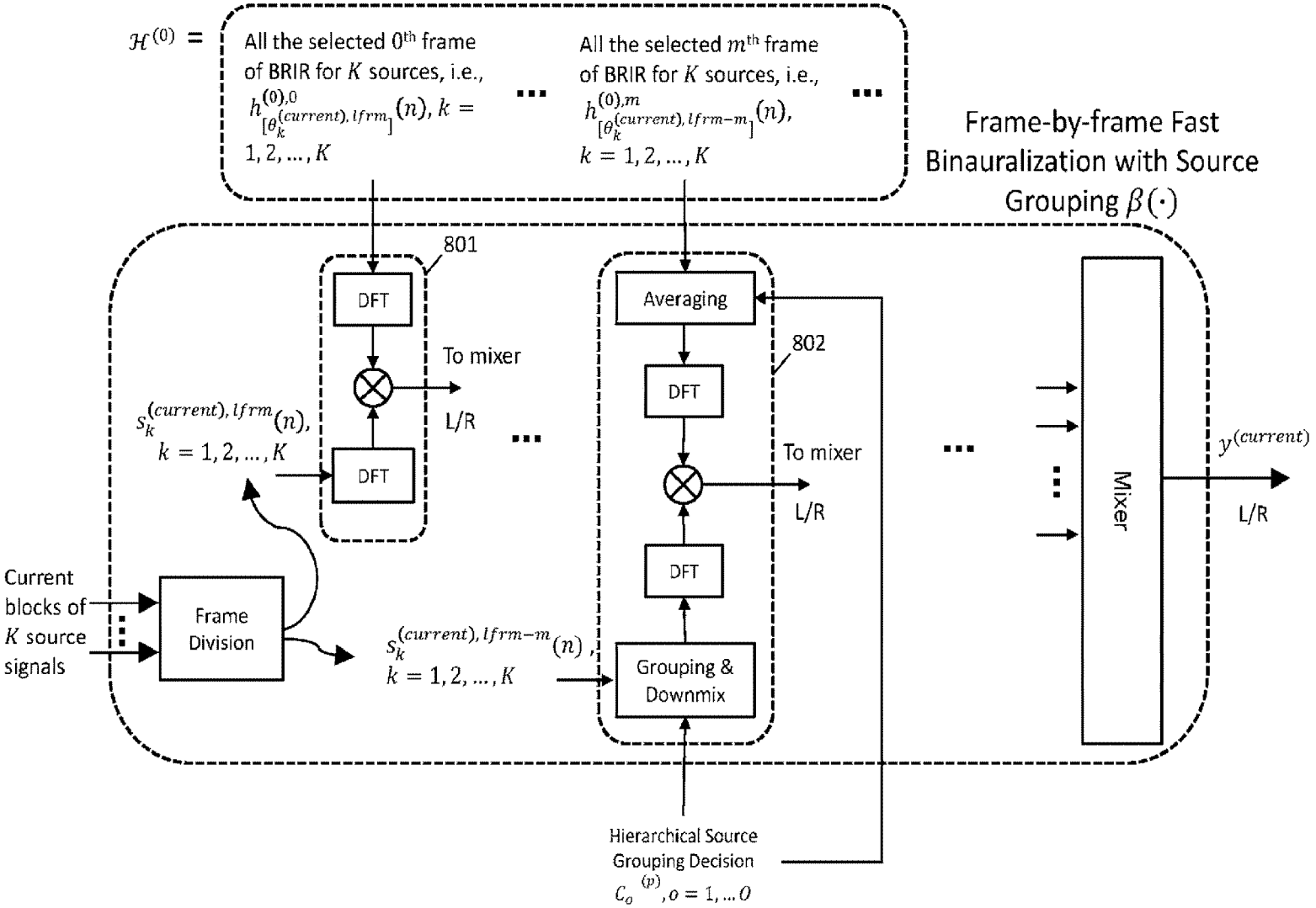

BINAURAL RENDERING APPARATUS AND METHOD FOR PLAYING BACK OF MULTIPLE AUDIO SOURCES

This is a continuation of U.S. application Ser. No. 16/341,861, filed Apr. 12, 2019, which is a national stage entry of International Patent Application No. PCT/JP2017/036738 filed Oct. 11, 2017, which claims the benefit of Japanese Patent Application No. 2016-211803, filed Oct. 28, 2016. The disclosure of these documents, including the specifications, drawings, and claims are incorporated herein by reference in their entirety.

TECHNICAL FIELD

The present disclosure relates to the efficient rendering of digital audio signals for headphone playback.

BACKGROUND ART

Spatial audio refers to an immersive audio reproduction system that allows the audience perceive high degree of audio envelopment. This sense of envelopment includes the sensation of spatial location of the audio sources, in both direction and distance, such that the audience perceive the sound scene as if they are in the natural sound environment.

There are three audio recording formats commonly used for spatial audio re-production system. The format depends on the recording and mixing approach used at the audio content production site. The first format is the most well-known channel-based whereby each channel of audio signals is designated to be playback on a particular loudspeaker at the reproduction site. The second format is called object—based whereby a spatial sound scene can be described by a number of virtual sources (also called objects). Each audio object can be represented by a sound waveform with the associated metadata. The third format is called Ambisonic-based which can be regarded as coefficient signals that represent a spherical expansion of the sound field.

With the proliferation of personal portable devices such as mobile phones, tablets, etc., and emerging applications of virtual/augmented reality, rendering the immersive spatial audio over headphones is becoming more and more necessary and attractive. Binauralization is the process of converting the input spatial audio signals, for example, channel-based signals, object-based signals or Ambisonic-based signals, into the headphone playback signals. In essence, the natural sound scene in a practical en-vironment is perceived by a pair of human ears. This infers that the headphone playback signals should be able to render the spatial sound scene as natural as possible if these playback signals are close to the sounds perceived by the human in the natural environment.

A typical example of the binaural rendering is documented in MPEG-H 3D audio standard [see NPL 1]. FIG. 1 illustrates the flow diagram of rendering the channel-based and object-based input signals to the binaural feeds in MPEG-H 3D audio standard. Given the virtual loudspeaker layout configuration (e.g., 5.1, 7.1 or 22.2), the channel-based signals 1 . . . $L_1$ and object based signals 1 . . . $L_2$ are firstly converted to a number of virtual loudspeaker signals via a format converter (101) and VBAP renderer (102), respectively. The virtual loudspeaker signals are then converted to the binaural signals via a binaural renderer (103) by taking into account the BRIR database.

CITATION LIST

Non Patent Literature

[NPL 1] ISO/IEC DIS 23008-3 "Information technology—High efficiency coding and media delivery in heterogeneous environments—Part 3: 3D audio"

[NPL 2] T. Lee, H. O. Oh, J. Seo, Y. C. Park and D. H. Youn, "Scalable Multiband Binaural Renderer for MPEG-H 3D Audio," in IEEE Journal of Selected Topics in Signal Processing, vol. 9, no. 5, pp. 907-920, August 2015.

SUMMARY OF INVENTION

One non-limiting and exemplary embodiment provides a method of a fast binaural rendering for multiple moving audio sources. The present disclosure takes the audio source signals which can be object-based, channel-based or a mixture of both, associated metadata, user head tracking data and binaural room impulse response (BRIR) database to generate the headphone playback signals. One non-limiting and exemplary embodiment of the present disclosure provides high spatial resolution and a low computational complexity when used in the binaural renderer.

In one general aspect, the techniques disclosed here feature a method of efficiently generating the binaural headphone playback signals given the multiple audio source signals with the associated metadata and binaural room impulse response (BRIR) database, wherein the said audio source signals can be channel-based, object-based, or a mixture of both signals. The method comprises a step of: (a) computing instant head-relative positions of the audio sources with respect to the position of user head and facing direction, (b) grouping the source signals according to the said instant head-relative positions of the audio sources in a hierarchical manner, (c) parameterizing BRIR to be used for rendering (or, dividing BRIR to be used for rendering into a number of blocks), (d) dividing each source signal to be rendered into a number of blocks and frames, (e) averaging the parameterized (divided) BRIR sequences identified with a hierarchically grouping result, and (f) downmixing (averaging) the divided source signals identified with the hierarchically grouping result.

It is useful for rendering fast moving objects using head-tracking enabled head-mounted device by using an method in an embodiment of the present disclosure.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF DRAWINGS

FIG. 1 shows the block diagram of rendering the channel-based and object-based signals to binaural ends in MPEG-H 3D audio standard.

FIG. 2 shows the block diagram of processing flow of binaural renderer in MPEG-H 3D audio.

FIG. 3 shows the block diagram of the proposed fast binaural renderer.

FIG. 4 shows the illustration of source grouping.

FIG. 5 shows the illustration of parameterizing the BRIR into blocks and frames.

FIG. 6 shows the illustration of applying different cut-off frequencies on different diffuse blocks.

FIG. 7 shows the block diagram of binaural renderer core.

FIG. 8 shows the block diagram of grouping based frame-by-frame binauralization.

DESCRIPTION OF EMBODIMENTS

Configurations and operations in embodiments of the present disclosure will be described below with reference to the drawings. The following embodiment is merely illustrative for the principles of various inventive steps. It is understood that variations of the details described herein will be apparent to others skilled in the art.

<Underlying Knowledge Forming Basis of the Present Disclosure>

The authors examined a method to solve the problems faced by the binaural renderer using MPEG-H 3D audio standard as a practical example.

<Problem 1: Spatial Resolution is Limited by Virtual Loudspeaker Configuration in a Channel/Object-Channel-Binaural Rendering Framework>

Indirect binaural rendering via conversion of channel-based and object-based input signals to the virtual loudspeaker signals first and then followed by conversion to the binaural signals is widely adopted in 3D audio system, such as in MPEG-H 3D audio standard. However, such a framework resulted in spatial resolution being fixed and limited by the configuration of the virtual loudspeakers in the middle of the rendering path. When the virtual loudspeaker is set as 5.1 or 7.1 configuration, for example, the spatial resolution is constrained by small number of the virtual loudspeakers, resulting that the user perceives the sound coming from only these fixed directions.

In addition, the BRIR database used in the binaural renderer (103) is associated with the virtual loudspeaker layout in a virtual listening room. This fact is deviated from the expected situation where the BRIRs should be the ones associated with the production scene if such information is available from the decoded bitstream.

Ways to improve the spatial resolution include the increase of the number of loudspeakers, e.g., to 22.2 configuration, or using an object-binaural direct rendering scheme. However, these ways may lead to a high computational complexity problem when BRIR is used as the number of input signals for binauralization is increased. The computational complexity issue is explained in the following paragraph.

<Problem 2: High Computational Complexity in Binaural Rendering Using BRIRs>

Due to the fact that the BRIR is generally a long sequence of impulses, direct convolution between BRIR and signal is highly computational demanding. Therefore, many binaural renderers seek for a tradoff between the computational complexity and spatial quality. FIG. 2 illustrates the processing flow of the binaural render (103) in MPEG-H 3D audio. This binaural renderer splits the BRIR into the "direct & early reflections" and "late reverberation" parts and process, these two parts separately. Since the "direct & early reflections" part reserves the most spatial information, this part of each BRIR is convolved with the signals separately in (201).

On the other hand, as the "late reverberation" part of BRIR contains less spatial information, the signals can be downmixed (202) into one channel such that the convolution needs to be performed only once with the downmixed channel in (203). Although this method reduces the computational load in the late reverberation processing (203), the computational complexity may still be very high for the direct and early part processing (201). This is because each of the source signals is processed separately in the direct and early part processing (201) and the computational complexity increases as the number of the source signals increases.

<Problem 3: Not Suitable for the Case of Fast Moving Objects or when the Head Tracking is Enabled>

The binaural renderer (103) considers the virtual loudspeaker signals as input signals and the binaural rendering can be performed by convolving each virtual loudspeaker signal with the corresponding pair of binaural impulse responses. The head related impulse response (HRIR) and binaural room impulse response (BRIR) are commonly used as the impulse response where the latter one consists of room reverberation filter coefficients which make it much longer than the HRIR.

The convolution process implicitly assumes that the source is at fixed position—which is true for the virtual loudspeaker. However, there are many cases where the audio sources can be moving. One example is the use of head mounted display (HMD) in virtual reality (VR) application where the positions of audio sources are expected to be invariant from any rotation of the user head. This is achieved by rotating the positions of objects or virtual loudspeakers in the reverse direction to wipe off the effect of user head rotation. Another example is the direct rendering of objects, where these objects can be moving with the varying positions specified in metadata.

Theoretically, there is no straight forward method to render a moving source due to that the rendering system is no longer a linear time invariant (LTI) system because of the moving source. However, approximation can be made such that the source is assumed to be stationary in a short period and within this short period, the LTI assumption is valid. This is the true when we use the HRIR and the source can be assumed stationary within the the filter length of HRIR (usually is a fraction of milisecond). Source signal frames can therefore be convolved with corresponding HRIR filters to generate the binarual feeds. However, when BRIR is used, due to that the filter length is generally much longer (e.g., 0.5 second), the source can no longer be assumed to be stationary during the BRIR filter length period. The source signal frame cannot be directly convolved with the BRIR filters, unless additional processing is applied on the convolution with BRIR filters.

Solution to Problem

The present disclosure comprises the followings. Firstly, it is the means of directly rendering the object-based and channel-based signals to the binaural ends without going through the virtual loudspeakers. It is possible to solve the spatial resolution limitation problem in <Problem 1>. Secondly, it is the means of grouping the close sources into one cluster such that some part of processing can be applied to the downmixed version of the sources within one cluster to save computational complexity problem in <Problem 2>. The means of splitting the BRIR into several blocks and further divides the direct block (corresponding to the direct and early reflections) into several frames and then perform binauralization filtering by a new frame-by-frame convolution scheme which selects the BRIR frame according to the instant position of the moving source to solve the moving source problem in <Problem 3>.

<Overall View of the Proposed Fast Binaural Renderer>

FIG. 3 shows the overview diagram of the present disclosure. The inputs for the proposed fast binaural renderer (306) include K audio source signals, source metadata which specifies the source positions/moving trajectories over a time period and a designated BRIR database. The aforementioned source signals can be either object-based signals, channel-based signals (virtual loudspeaker signals) or a mixture of both, and the source positions/moving trajectories can be position series over a time period for the object-based sources or stationary virtual loudspeaker positions for the channel-based sources.

In addition, the inputs also include an optional user head tracking data, which can be the instant user head facing direction or position, if such information is available from external applications and the rendered audio scene is required to be adapted with respect to the user head rotation/movement. The outputs of the fast binaural renderer are the left and right headphone feed signals for user listening.

To obtain the outputs, the fast binaural renderer first comprises of a head-relative source position computation module (301) which computes the relative source positions with respect to the instant user head facing direction/position by taking the instant source metadata and user head tracking data. The computed head-relative source positions are then used in a hierarchical source grouping module (302) to generate the hierarchical source grouping information and binaural renderer core (303) for selecting the parameterized BRIRs according to the instant source positions. The hierarchical information generated by (302) is also used in the binaural renderer core (303) for the purpose of reducing the computational complexity. The details of the hierarchical source grouping module (302) are described in Section <Source grouping>.

The proposed fast binaural render also comprises of a BRIR parameterization module (304) which splits each BRIR filter into several blocks. It further divides the first block into frames and attaches each frame with corresponding BRIR target position label. The details of the BRIR parameterization module (304) are described in Section <BRIR Parameterization>.

Note that the proposed fast binaural renderer considers the BRIRs as the filters for rendering the audio sources. In the case where the BRIR database is not adequate or the user prefers to use a high resolution BRIR database, the proposed fast binaural render supports an external BRIR interpolation module (305) which interpolates the BRIR filters for the missing target locations based on the nearby BRIR filters. However, such an external module is not specified in this document.

Finally, the proposed fast binaural renderer comprises of a binaural renderer core (303) which is the core processing unit. It takes the aforementioned individual source signals, the computed head-relative source positions, the hierarchical source grouping information and the parameterized BRIR blocks/frames for generating the headphone feeds. The details of the binaural renderer core (303) are described in Section <Binaural renderer core> and Section <Source grouping based frame-by-frame binaural rendering>.

<Source Grouping>

The hierarchical source grouping module (302) in FIG. 3 takes the computed instant head-relative source positions as inputs for computing the audio source grouping information based on similarity, e.g., the inter-distance, between any two audio sources. Such grouping decision can be made hierarchically with P layers where the higher layer has a lower resolution while the deeper layer has a higher resolution for grouping the sources. The 0th cluster of the pth layer is denoted as $$C_0^{(p)} \quad \text{[Math.1]}$$

Where 0 is the cluster index and p is the layer index. FIG. 4 illustrates a simple example of such hierarchical source grouping when P=2. The figure is shown as a top view where the origin indicates the user (listener) position, the direction of y-axis indicates the user facing direction and the sources are plotted according to their two-dimensional head-relative positions computed from (301) with respect to the user. The deep layer (the first layer: p=1) groups sources into 8 clusters where the first cluster $C_1^{(1)}=\{1\}$ contains source 1, the second cluster $C_2^{(1)}=\{2,3\}$ contains source 2 and 3, the third cluster $C_3^{(1)}=\{4\}$ contains source 4 and so on. The high layer (the second layer: p=2) groups the sources into 4 clusters, where the source 1, 2 and 3 are grouped into cluster 1, denoted by $C_1^{(2)}=\{1,2,3\}$, source 4 and 5 are grouped into cluster 2, denoted by $C_2^{(2)}=\{4,5\}$, and source 6 is grouped into cluster 3, denoted by $C_3^{(2)}=\{6\}$.

The number of layers P is chosen by the user depending on the system complexity re-quirement and can be greater than 2. A proper hierarchy design with lower resolution on the high layers can result in a lower computational complexity. To group the sources, a simple way is based on division of the whole space where the audio sources exist into a number of small areas/enclosures, as illustrated in the previous example. The sources are therefore grouped based on which area/enclosure they fall into. More professionally, the audio sources can be grouped based on some particular clustering algorithms, e.g., k-means, fuzzy c means algorithms. These clustering algorithms compute the similarity measures between any two sources and grouped the sources into clusters.

<BRIR Parameterization>

This section describes the processing procedures in BRIR parameterization module (304) in FIG. 3 which takes a designated BRIR database or an interpolated BRIR database as inputs. FIG. 5 shows the procedure of parameterizing one of the BRIR filters into blocks and frames. In general, a BRIR filter can be long, e.g., greater than 0.5 second in a hall, due to the inclusion of room reflections.

As discussed in the above, use of such long filter results in high computational complexity if direct convolution is applied between the filter and source signal. The computational complexity would increase if the number of audio sources increases. To save computational complexity, each BRIR filter is divided into direct block and diffuse blocks and a simplified processing, as described in Section <Binaural renderer core>, is applied on the diffuse blocks. Dividing the BRIR filter into blocks can be de-termined by the energy envelop of each BRIR filter and inter-aural coherence between the filters in pair. As the energy and inter-aural coherence reduces with time increases in BRIRs, the time points for separating the blocks can be derived empirically using existing algorithms [see NPL 2]. FIG. 5 shows the example where a BRIR filter has been divided into a direct block and W diffuse blocks. The direct block is denoted as $$h_\theta^{(0)}(n) \quad \text{[Math.2]}$$

where n denotes the sample index, superscript (0) denotes direct block and θ denotes the target location of this BRIR filter. Similarly, the wth diffuse block is denoted as $$h_\theta^{(w)}(n), w=1,2,\ldots,W \quad \text{[Math.3]}$$

where w is the diffuse block index. Furthermore, as shown in FIG. 6, different cut-off frequencies $f_1, f_2, \ldots$, which are the outputs of (304) in FIG. 3, are computed for each block based on the energy distribution in the time-frequency domain of the BRIRs. In the binaural renderer core (303) in FIG. 3, the frequencies above the cut-off frequencies $f_w$ (low energy portions) are not processed in order to save computational complexity. Since the diffuse blocks contain less directional information, they will be used in the late reverberation processing module (703) in FIG. 7 which processes a downmixed version of the source signals to save computational complexity, which is elaborated in Section <Binaural renderer core> in details.

On the other hand, the direct block of BRIR contains important directional information and will generate the directional cues in the binaural playback signals. To cater for the scenario where the audio sources are moving fast, rendering is to be performed based on the assumption that audio source is only stationary during a short time period (i.e., time frame with length of, e.g., 1024 samples at 16 kHz sampling rate), and binauralization is processed frame by frame in a module of source grouping based frame-by-frame binauralization (701) shown in FIG. 7. Therefore, the direct block $h_0^{(0)}(n)$ is divided into frames which are denoted by $$h_\theta^{(0),m}(n) \quad \text{[Math.4]}$$

where m=0, . . . , M denotes the frame index and M is the total number of frames in the direct block. The divided frames are also assigned position labels θ which correspond to the target location of this BRIR filter.

<Binaural Renderer Core>

This section describes the details of binaural renderer core (303) as shown in FIG. 3 which takes the source signals, the parameterized BRIR frames/blocks and computed source grouping information for generating the headphone feeds. FIG. 7 shows the processing diagram of the binaural renderer core (303) which processes the current block and previous blocks of the source signal separately. Firstly, each source signal is divided into current block and W previous blocks where W is the number of diffuse BRIR blocks defined in Section <BRIR parameterization>. The current block of the kth source signal is denoted as $$s_k^{(current)}(n) \quad \text{[Math.5]}$$

and the previous wth block is denoted as $$s_k^{(current-w)}(n), w=1,2, \ldots, W. \quad \text{[Math.6]}$$

As shown in FIG. 7, the current block of each source is processed in the frame-by-frame fast binauralization module (701) using the direct block of BRIR. This process is denoted by $$y^{(current)}=\beta(s_1^{(current)}(n), \ldots, s_k^{(current)}(n), H^{(0)}) \quad \text{[Math.7]}$$

where $y^{(current)}$ denotes the output of (701) and the function β(·) denotes the processing function of (701) which takes hierarchical source grouping information generated from (302) in FIG. 3, the current blocks of all the source signals and the BRIR frames in the direct block as inputs, $H^{(0)}$ denotes a collection of the BRIR frames of the direct block corresponding to all the instant frame-wise source locations during the current block time period. The details of this frame-by-frame fast binauralization module (701) are described in Section <Source grouping based frame-by-frame binaural rendering>.

On the other hand, the previous blocks of source signals will be downmixed in the downmxing module (702) into one channel and passed to the late reverberation processing module (703). The late reverberation processing in (703) is denoted by $$y^{(current-w)} = \gamma\left(\frac{1}{K}\sum_{k=1}^{K} s_k^{(current-w)}(n), h_{\theta_{ave}}^{(w)}(n)\right) \quad \text{[Math. 8]}$$

where $y^{(current-w)}$ denotes the output of (703), γ(·) denotes the processing function of (703) which takes the downmixed version of the previous blocks of source signals, and the diffuse blocks of BRIRs as inputs. The variable $\theta_{ave}$ denotes the averaged location of all the K sources at the block current-w.

Note that this late reverberation processing can be performed in time-domain using convolution. It can also be implemented by multiplication in frequency domain using fast Fourier transform (FFT) with cut-off frequencies $f_w$ applied. It is also worth noting that time-domain downsampling can be implemented on the diffuse blocks depending on the target system computational complexity. Such downsampling can reduce the number of signal samples, and thus reduce the number of multiplications in the FFT domain, resulted a reduced computational complexity.

Given the above, the binaural playback signal is finally generated by $$y^{current} + \sum_{w=1}^{W} y^{(current-w)} = y^{current} + \sum_{w=1}^{W} \gamma\left(\frac{1}{K}\sum_{k=1}^{K} s_k^{(current-w)}(n), h_{\theta_{ave}}^{(w)}(n)\right) \quad \text{[Math. 9]}$$

As shown in the above equation, for each diffuse block w, due to that a downmix processing $$\frac{1}{K}\sum_{k=1}^{K} s_k^{(current-w)}(n)$$

is applied on the source signals, the late reverberation processing γ(·) only needs to be performed once. Compared to the case of a typical direct convolution approach where such processing (filtering) has to be performed separately for K number of source signals, the present disclosure reduces the computational complexity.

<Source Grouping Based Frame-by-Frame Binaural Rendering>

This section describes the details of the source grouping based frame-by-frame binauralization module (701) in FIG. 7 which processes the current block of the source signals. To start with, the current block of the kth source signal $s_k^{(current)}(n)$ is divided into frames, where the latest frame is denoted by $s_k^{(current), lfrm}(n)$ and the previous mth frame is denoted by $s_k^{(current), lfrm-m}(n)$ The frame length of source signal is equivalent to the frame length of the direct block of BRIR filter.

As shown in FIG. 8, the latest frame $s_k^{(current), lfrm}(n)$ is convolved with the 0th frame of the direct block of BRIR $$h_{[\theta_k^{(current)}, lfrm]}^{(0),0}(n)$$

contained in the collection $H^{(0)}$. This BRIR frame is selected by searching for the labelled location of BRIR frame $[\theta_k^{(current),lfrm}]$ which is closest to the instant position of the source $\theta_k^{(current),lfrm}$ at the latest frame, where $[\theta_k^{(current),lfrm}]$ denotes finding the nearest value of label in the BRIR database. Due to that the 0th frame of BRIR contains the most directional information, the convolution is performed with each source signal individually to reserve the spatial cues of each source. The convolution can be performed using multiplication in frequency domain, as illustrated in (801) in FIG. 8.

For each of the previous frames $s_k^{(current),lfrm-m}(n)$ where $m \geq 1$, the convolution is supposed to be performed with the mth frame of the direct block of BRIR $$h_{[\theta_k^{(current),lfrm-m}]}^{(0),m}(n)$$

contained in $H^{(0)}$, where $[\theta_k^{(current),lfrm\ m}]$ denotes the labelled position of that BRIR frame which is closest to the source position of at the frame lfrm-m.

Note that as m increases, the directional information contained in $$h_{[\theta_k^{(current),lfrm-m}]}^{(0),m}(n)$$

reduces. Because of this, to save computational complexity and as shown in (802), the present disclosure applies a downmixing for $s_k^{(current),\ lfrm-m}(n)$, k=1, 2, . . . K where $m \geq 1$ according to the hierarchical source grouping decision $C_\upsilon^{(p)}$) (generated from (302) and discussed in Section <Source grouping>), followed by a convolution with this downmixed version of the source signal frames.

For example, if the second layer source grouping is applied on the signal frame $s_k^{latest\ frame-2}(n)$ (i.e., m=2) and that the source 4 and 5 are grouped into the second cluster $C_2^{(2)}=\{4,5\}$, the downmix can be applied by averaging the source signals as $(s_4^{latest\ frame-2}(n)+s_5^{latest\ frame-2}(n))/2$ and the convolution is applied between this averaged signal and the BRIR frame with the averaged source location at that frame.

Note that different hierarchical layers can be applied on the frames. In essence, high resolution grouping should be considered for the early frames of BRIRs to reserve the spatial cues, while low resolution grouping is considered for the late frames of BRIRs for reduction of computational complexity. Finally the frame-wised processed signals are passed to a mixer which performs a summation to generate the output of (701), i.e., $y^{(current)}$.

In the foregoing embodiments, the present present disclosure is configured with hardware by way of the above explained example, but the present disclosure may also be provided by software in cooperation with hardware.

In addition, the functional blocks used in the descriptions of the embodiments are typically implemented as LSI devices, which are integrated circuits. The functional blocks may be formed as individual chips, or a part or all of the functional blocks may be integrated into a single chip. The term "LSI" is used herein, but the terms "IC," "system LSI," "super LSI" or "ultra LSI" may be used as well depending on the level of integration.

In addition, the circuit integration is not limited to LSI and may be achieved by dedicated circuitry or a general-purpose processor other than an LSI. After fabrication of LSI, a field programmable gate array (FPGA), which is programmable, or a reconfigurable processor which allows reconfiguration of connections and settings of circuit cells in LSI may be used.

Should a circuit integration technology replacing LSI appear as a result of advancements in semiconductor technology or other technologies derived from the technology, the functional blocks could be integrated using such a technology. Another possibility is the application of biotechnology and/or the like.

INDUSTRIAL APPLICABILITY

This disclosure can be applied to a method for rendering of digital audio signals for headphone playback.

REFERENCE SIGNS LIST

101 format converter
102 VBAP renderer
103 binaural renderer
201 direct and early part processing
202 downmix
203 late reverberation part processing
204 mixing
301 head-relative source position computation module
302 hierarchical source grouping module
303 binaural renderer core
304 BRIR parameterization module
305 external BRIR interpolation module
306 fast binaural renderer
701 frame-by-frame fast binauralization module
702 downmixing module
703 late reverberation processing module
704 summation

What is claimed is:

1. A method of generating binaural headphone playback signals given multiple audio source signals with an associated metadata and binaural room impulse response (BRIR) database, wherein the multiple audio source signals can be channel-based, object-based, or a mixture of both signals, the method comprising:

grouping the multiple audio source signals according to positions of the audio sources in a hierarchical manner;

parameterizing BRIR to be used for rendering;

dividing each audio source signal to be rendered into a number of blocks and frames;

averaging the parameterized BRIR sequences identified with a hierarchically grouping result; and downmixing the divided audio source signals identified with the hierarchically grouping result.

2. The method according to claim 1, wherein the audio source position is computed for each time frame/block of the multiple audio source signals given the source metadata and user head tracking data.

3. The method according to claim 1, wherein the grouping is performed hierarchically with a number of layers with different grouping resolution, given the computed instant source positions for each frame.

4. The method according to claim 1, wherein each BRIR filter signal in the BRIR database is divided into a direct block consisting of a few frames, and a number of diffuse blocks, and the frames and blocks are labelled using the target location of that BRIR filter signal.

5. The method according to claim 1, wherein the audio source signal is divided into the current block and a number of previous blocks, and the current block is further divided into a number of frames.

6. The method according to claim 1, wherein frame-by-frame binauralization processing is performed for the frames of the current block of the audio source signals using the selected BRIR frames, and the selection of each BRIR frame is based on searching for the nearest labelled BRIR frame that is closest to the computed position of each source.

7. The method according to claim 1, wherein frame-by-frame binauralization processing is performed with an incorporation of an audio source signal downmix module such that the multiple audio source signals can be downmixed according to the computed source grouping decision and the binauralization processing is applied on the downmixed signals to reduce computational complexity.

8. The method according to claim 1, wherein late reverberation processing is performed on a downmixed version of the previous blocks of the audio source signals using the diffuse blocks of BRIRs, and different cut-off frequencies are applied on each block.

9. An integrated circuit (IC) for generating binaural headphone playback signals given the multiple audio source signals with an associated metadata and binaural room impulse response (BRIR) database, wherein the audio source signals can be channel-based, object-based, or a mixture of both signals, the integrated circuit comprising:

one or more processors; and one or more memories, the integrated circuit configured to execute operations, including grouping the multiple audio source signals according to positions of the audio sources in a hierarchical manner;

parameterizing BRIR to be used for rendering;

dividing each audio source signal to be rendered into a number of blocks and frames;

averaging the parameterized BRIR sequences identified with a hierarchically grouping result; and downmixing the divided audio source signals identified with the hierarchically grouping result.

10. The integrated circuit according to claim 9, wherein the audio source position is computed for each time frame/block of the multiple audio source signals given the source metadata and user head tracking data.

11. The integrated circuit according to claim 9, wherein the grouping is performed hierarchically with a number of layers with different grouping resolution, given the computed instant source positions for each frame.

12. The integrated circuit according to claim 9, wherein each BRIR filter signal in the BRIR database is divided into a direct block consisting of a few frames, and a number of diffuse blocks, and the frames and blocks are labelled using the target location of that BRIR filter signal.

13. The integrated circuit according to claim 9, wherein the audio source signal is divided into the current block and a number of previous blocks, and the current block is further divided into a number of frames.

14. The integrated circuit method according to claim 9, wherein frame-by-frame binauralization processing is performed for the frames of the current block of the audio source signals using the selected BRIR frames, and the selection of each BRIR frame is based on searching for the nearest labelled BRIR frame that is closest to the computed position of each source.

15. The integrated circuit according to claim 9, wherein frame-by-frame binauralization processing is performed with an incorporation of an audio source signal downmix module such that the audio source signals can be downmixed according to the computed source grouping decision and the binauralization processing is applied on the downmixed signals to reduce computational complexity.

16. The integrated circuit according to claim 9, wherein late reverberation processing is performed on a downmixed version of the previous blocks of the audio source signals using the diffuse blocks of BRIRs, and different cut-off frequencies are applied on each block.

* * * * *